United States Patent [19]

Fabrig

[11] 4,425,773

[45] Jan. 17, 1984

[54] APPARATUS FOR WINDING HELICAL WIRE COILS

[75] Inventor: Paul Fabrig, Neuffen, Fed. Rep. of Germany

[73] Assignee: Womako Maschinenkonstruktionen GmbH, Nürtingen, Fed. Rep. of Germany

[21] Appl. No.: 321,792

[22] Filed: Nov. 16, 1981

[30] Foreign Application Priority Data

Nov. 15, 1980 [DE] Fed. Rep. of Germany ..... 3043271

[51] Int. Cl.[3] ..... B21F 3/04

[52] U.S. Cl. ..... 72/142; 140/92.3; 140/92.94

[58] Field of Search ..... 72/135, 141, 142, 145; 140/92.3, 92.4, 92.94

[56] References Cited

U.S. PATENT DOCUMENTS

| | | | |
|---|---|---|---|
| 190,139 | 5/1877 | Hoffman | 72/145 X |
| 3,101,750 | 8/1963 | Pfaffle | 140/92.3 |
| 3,520,334 | 7/1970 | Mueller | 140/92.94 |
| 3,568,728 | 3/1971 | Mueller | 140/92.94 |
| 3,818,954 | 6/1974 | Pfaffle | 140/92.3 |

FOREIGN PATENT DOCUMENTS

| | | | |
|---|---|---|---|
| 83079 | 10/1895 | Fed. Rep. of Germany | 72/135 |
| 362058 | 10/1922 | Fed. Rep. of Germany | 72/142 |
| 1052939 | 3/1959 | Fed. Rep. of Germany | 72/145 |
| 2234633 | 1/1974 | Fed. Rep. of Germany . | |
| 2835511 | 2/1980 | Fed. Rep. of Germany . | |
| 329747 | 6/1958 | Switzerland | 140/92.3 |

*Primary Examiner*—E. Michael Combs

*Attorney, Agent, or Firm*—Kontler, Grimes & Battersby

[57] ABSTRACT

Apparatus for winding helical wire coils which can be subdivided into discrete spiral binders for insertion into the perforations of steno pads, exercise books or like stationery products has a rotary mandrel whose periphery is adjacent to several rows of rotary wire guiding pins defining a helical path extending around the periphery of the mandrel. The axes of the pins are slightly offset with reference to radial positions relative to the mandrel so that the pins can readily rotate in response to lengthwise movement of the wire therealong and their inner end faces can be placed sufficiently close to the periphery of the mandrel so as to prevent a thin wire from penetrating into the space between the end face of a pin and the periphery of the mandrel. When a feeding device supplies a continuous length of wire into the inlet of the helical path, the wire is entrained by the periphery of the mandrel and is caused to advance along the helical path with attendant conversion into the convolutions of a coil moving axially of the mandrel under the action of the pins which rotate in response to movement of the wire therealong. Those end portions of the pins which are immediately adjacent to the mandrel may resemble conical frusta. The pins are mounted in holders which are adjustable axially of the pins, and each pin is adjustable axially in the respective holder.

11 Claims, 4 Drawing Figures

APPARATUS FOR WINDING HELICAL WIRE COILS

CROSS-REFERENCE TO RELATED CASE

The construction of the apparatus of the present invention is identical with that of apparatus which are disclosed in the commonly owned copending application Ser. No. 321,809 filed by me on Nov. 16, 1981 for "Apparatus for producing helical wire coils".

BACKGROUND OF THE INVENTION

The present invention relates to apparatus for making helical wire coils from metallic, plastic or other wire. More particularly, the invention relates to improvements in apparatus for making wire coils of the type which can be subdivided into spiral binders for threading into the perforations of steno pads, exercise books and analogous stationary products.

Apparatus of the above outlined type comprise a rotary coiling mandrel and several pin-shaped wire guiding elements which are disposed around the periphery of the mandrel to form a helical path whose inlet receives a continuous length of wire from a suitable feeding device. The distribution of guiding elements at the periphery of the mandrel corresponds to the desired lead or pitch of the wire coil. The purpose of the guiding elements is to guide the wire as well as to cause successively formed convolutions of the coil to advance axially of the mandrel.

An apparatus of the just outlined character is disclosed, for example, in German Pat. No. 1,902,623. The guiding elements are cylindrical pins which are nonrotatably mounted at the periphery of the mandrel and form several rows. Thus, the wire which is in the process of being converted into the convolutions of a coil must slide along the peripheral surfaces of stationary pins. Those end portions of the pins which are adjacent to the mandrel have a concave shape conforming to the convex shape of the peripheral surface of the mandrel. This renders it possible to use the pins into immediate proximity of the mandrel, i.e., the clearances between the concave end faces of the pins and the mandrel are narrower than the diameter of the thinnest wire which is to be converted into a coil. Therefore, even a very thin wire is not likely to penetrate between the mandrel and one or more pins where it could jam and necessitate a lengthy interruption of operation of the winding apparatus. Each interruption is especially undesirable when the apparatus is installed in a complete production line which converts larger sheets into a succession of stationery products wherein stacks of overlapping sheets are held together by spiral binders.

Since the pins of the patented apparatus are cylindrical bodies and the wire has a round cross section, the wire is in mere point contact with the pins and slides therealong, i.e., the slippage between each pin and the wire is 100 percent. Such point contact between the wire and the pins results in highly localized and highly pronounced stressing of the wire, i.e., the wire is subjected to pronounced compressive and deforming stresses which are likely to result in damage to the surface of the wire, especially if the wire comprises a metallic core and a plastic sheath around the core.

Another apparatus is disclosed in German Offenlegungsshrift No. 2,234,633 which proposes to use guiding elements in the form of ball bearings. The wire contacts and thereby rotates the outer races of the ball bearings. Such apparatus can be used only for the making of large-diameter wire coils, i.e., for the processing of relatively thick wire, because (when compared with the diameters of pin-shaped guiding elements) the diameters of the ball bearings are rather large and such bearings occupy a substantial amount of space at the periphery of the mandrel so that they cannot be used for the making of coils having a small pitch, i.e., with convolutions closely adjacent to each other. Therefore, when the wire coil is to be made of thin wire, the apparatus which is disclosed in the aforediscussed German Pat. No. 1,902,623 is preferred over the apparatus which employs guiding elements in the form of ball bearings. In other words, when a conventional apparatus is to produce small-diameter wire coils of thin wire and small pitch, at least some damage to the surface of the wire is unavoidable. Alternatively, such relatively small wire coils cannot be made of certain types of wire, namely, of wire having a plastic sheath which is likely to be damaged on contact with fixedly mounted stationary cylindrical guiding elements.

OBJECTS AND SUMMARY OF THE INVENTION

An object of the invention is to provide an apparatus for making helical wire coils which is constructed and assembled in such a way that it invariably ensures the making of coils with satisfactory exposed surfaces regardless of whether the coils are made of metallic wire or of wire wherein a plastic sheath surrounds a metallic core.

Another object of the invention is to provide an apparatus which prevents the wire from penetrating between the mandrel and the wire guiding elements irrespective of the selected diameter of the wire.

A further object of the invention is to provide novel and improved wire guiding elements for use in an apparatus of the above outlined character.

An additional object of the invention is to provide the apparatus with novel and improved means for mounting the wire guiding elements at the periphery of the mandrel.

A further object of the invention is to provide the apparatus with novel and improved means for adjusting the wire guiding elements for the production of differently dimensioned coils.

Another object of the invention is to provide the apparatus with novel and improved means for ensuring that the wire guiding elements can be placed close to the periphery of the mandrel even though the guiding elements need not be held against rotation with reference to their supports.

Still another object of the invention is to provide the apparatus with novel and improved means for protecting the surface of the wire against damage and/or defacing in the course of conversion into the convolutions of a helical wire coil which can be subdivided into spiral binders for use in steno pads, exercise books and analogous stationary products.

The invention is embodied in an apparatus for converting a length of wire into a helical wire coil of predetermined pitch or lead. The apparatus comprises a rotary coiling mandrel and a plurality of substantially pin-shaped wire guiding elements which are adjacent to the periphery of the mandrel and are distributed in accordance with the pitch of the coil to be wound so as to define a helical path having an inlet and an outlet.

The wire guiding elements are rotatable about their respective axes, and such axes are slightly offset with reference to radial positions relative to the mandrel. The apparatus further comprises means for feeding the wire into the inlet of the helical path whereby the rotating mandrel advances the wire along the path and the guiding elements (which are rotated as a result of engagement with the wire) shift the thus formed convolutions of wire coil axially of the mandrel so that the outlet of the aforementioned path discharges a continuous helical wire coil which can be subdivided into spiral binders for use in steno pads, exercise books or analogous stationery products.

The wire guiding elements are preferably movable axially in directions substantially radially toward and away from the periphery of the coiling mandrel, and the apparatus preferably comprises means for maintaining the guiding elements in selected axial positions.

The apparatus further comprises holder means for rotatably supporting the wire guiding elements. The holder means may comprise three discrete holders each of which supports a row of wire guiding elements, and such rows are preferably but need not be parallel to the axis of the mandrel. The holders can be adjustably mounted on a support (e.g., a housing wherein a portion of the mandrel rotates), and each holder is preferably adjustable substantially radially of the mandrel and more specifically in the axial direction of the respective guiding elements. Thus, the holders are adjustable in the axial direction of the respective guiding elements, and the guiding elements are adjustable axially in the respective holders. The means for maintaining the guiding elements in selected axial positions with reference to their holders may comprise locking screws which mesh with the holders and extend into bores or holes provided in the holders and rotatably receiving the guiding elements.

In accordance with a presently preferred embodiment of the apparatus, the wire guiding elements have conical (e.g., frustoconical) end portions adjacent to the external surface of the coiling mandrel.

The extent to which the guiding elements are offset with reference to radial positions relative to the coiling mandrel may equal or approximate the radius of a guiding element. All that counts is to mount the guiding elements in such positions that they can rotate about their own axes and are still sufficiently close to the external surface of the mandrel to prevent even relatively thin wire from penetrating between the periphery of the mandrel and those end faces of the guiding elements which are adjacent to the periphery of the mandrel.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 2:
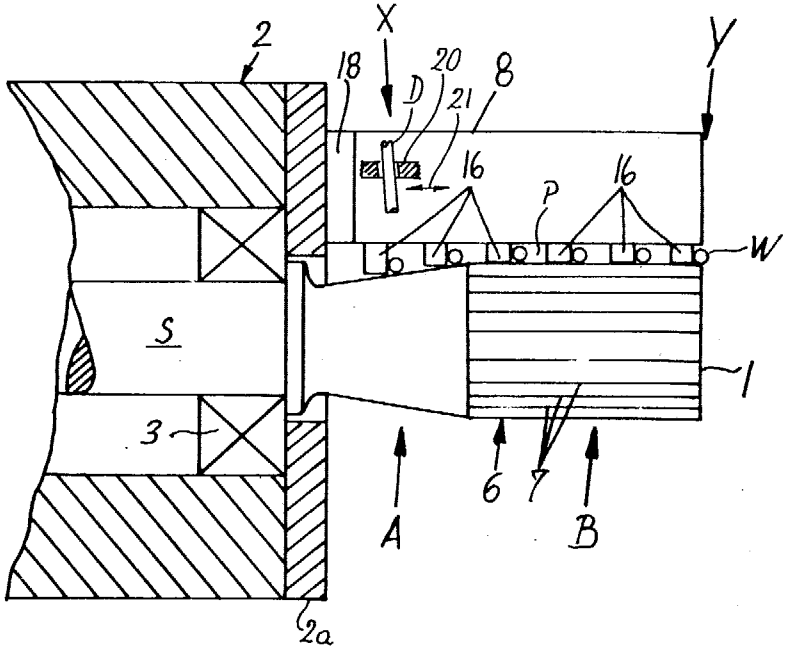
FIG. 2 is a sectional view as seen in the direction of arrows from the line II—II of FIG. 1.
Figure 1:
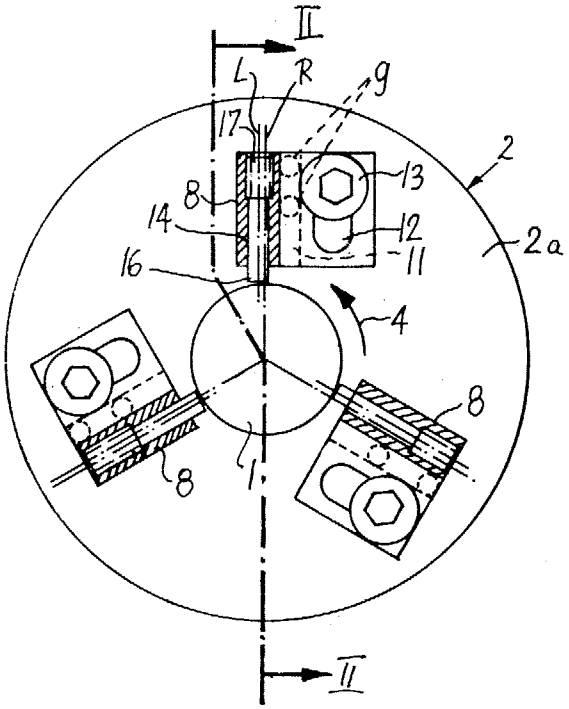
FIG. 1 is a somewhat schematic end elevational view of an apparatus which embodies one form of the invention, the holders for the wire guiding elements being shown in partial section.

Referring first to FIGS. 1 and 2, there is shown an apparatus which converts a continuous length of wire D into a helical wire coil W. The apparatus comprises a rotary coiling tool 1 in the form of a mandrel having a frustoconical section A and a cylindrical section B. The larger-diameter end of the frustoconical section A is adjacent to the respective end of the cylindrical section B, and the smaller-diameter end of the section A is adjacent to and coupled or made integral with a drive means here shown as a motor-driven shift S installed in a stationary cylindrical housing 2. The shaft S and/or the respective end of the frustoconical mandrel section A is journalled in several antifriction bearings 3, e.g., in ball bearings of which only one is shown in FIG. 2. The direction in which the shaft S is driven when the motor (not shown) is on is indicated by the arrow 4.

The front end portion of the housing 2 is constituted by a washer-like plate 2*a* which carries composite holder means including three equidistant holders 8 for sets or rows of discrete wire guiding elements in the form of rotary guide pins or studs 16. The pins 16 are adjacent to and extend substantially but not exactly radially of the mandrel 1 to define a helical path P whose lead equals or approximates the desired lead of the helical wire coil W. The path P has an inlet X where the wire D is fed thereinto by a supplying device 20 which is preferably adjustable in directions indicated by arrow 21 to thereby vary the lead angle of the wire. The axial length of that portion of the frustoconical section A which extends between the inlet X and the adjacent end of the cylindrical section B is less than the length of the section B. In fact, the length of the entire section A need not exceed and can be less (see FIG. 2) than the length of the section B.

The peripheral surface 6 of the cylindrical section B is roughened (i.e., its non-skidding properties are enhanced) by the provision of elongated flutes or grooves 7 which extend in parallelism with the axis of the mandrel 1.

The three holders 8 are preferably identical as to their dimensions and also as concerns the distribution of their wire guiding pins 16. The aforementioned helical path P is defined by the three sets of pins 16 because two of the holders 8 are secured to the plate 2*a* of the housing 2 by interposition of distancing elements 18 having different thicknesses (only one such distancing element can be seen in FIG. 2). Owing to the placing of distancing elements 18 between the plate 2*a* and two of the three holders 8, the three sets of pins 16 are disposed at different distances from the outer side of the plate 2*a*, i.e., they are staggered with reference to each other, as considered in the axial direction of the sections A and B.

Each of the holders 8 is adjustable with reference to the housing 2, as considered in the axial direction of its pins 16. To this end, the plate 2*a* of the housing 2 carries two posts 9 for each of the three holders 8, i.e., a total of six posts 9, and the exposed portions of such posts (whose inner portions can extend into tapped bores of the plate 2a) extend into grooves 11 which are machined into the concealed surfaces of the respective holders 8, i.e., into those surfaces which are adjacent to the plate 2a or to the respective distancing elements 18. The posts 9 cooperate with the surfaces surrounding the corresponding grooves 11 to guide the respective holders 8 during adjustment with reference to the mandrel 1. When a holder 8 assumes the desired position, it is fixed to the plate 2a by a bolt 13 whose shank extends through an elongated slot 12 to the respective holder. The slots 12 are parallel with the adjacent grooves 11 and with the axes L of the respective pins 16.

Each holder 8 is formed with six bores 14 for an equal number of pins 16. The pins 16 are partially confined in the respective bores 14 and are held in selected axial positions by locking screws 17 extending into the outer portions of the bores 14 and meshing with the corresponding holders 8. Each pin 16 is rotatable in the respective bore 14, and its inner end portion extends towards the exposed surface of the section A or B of the mandrel 1. The operator can change the extent to which the inner end portions of the pins 16 project beyond the respective holes 14 or the extent to which the pins 16 can penetrate into the respective holes 14 by rotating the associated screws 17.

As mentioned above, the dimensions of the distancing elements 18 are selected with a view to ensure that the lead of helical the path P equals or approximates the desired lead of the coil W. FIG. 1 shows that the guide pins 16 are slightly offset with reference to positions in which their axes L would extend radially (see the radius R) of the mandrel 1; the extent of such offset equals or approximates the radius of a pin 16.

The operation:

The means which feeds wire D to the supplying device 20 is not specifically shown in the drawing. The device 20 feeds successive increments of the wire D into the inlet X of the path P, and such wire advances along the path P to form a series of convolutions surrounding first the frustoconical section A and thereupon the cylindrical section B on their way toward and beyond the discharge end Y of the path P. The pins 16 rotate as a result of engagement with the advancing convolutions of the wire D. The wire is stretched during travel around the surface of the frustoconical section A so that it undergoes permanent deformation and its convolutions remain unchanged during travel along the surface 6 of the cylindrical section B. The latter ensures the establishment of desirable force-locking engagement between the wire D and the mandrel 1. When a convolution advances all the way to the discharge end Y, it is free to slip with reference to the mandrel 1 and to contract thereafter. This ensures that the coil W which advances beyond the cylindrical section B remains coaxial with the mandrel 1.

A relatively short frustoconical section A (or a relatively short distance between the inlet X and the adjacent end of the cylindrical section B) whose axial length is or can be less than that of the section B reduces the likelihood of damage to the surface of the wire D during conversion into convolutions of the coil W. The grooves 7 in the surface 6 of the section B not only enhance the force-locking engagement between the mandrel 1 and the convolutions of the coil W but they also reduce the likelihood of damage to the surface of the wire during travel axially of the section B. Once a convolution has advanced onto the surface 6 of the section B, it moves only axially of the mandrel 1, i.e., in the longitudinal direction of the grooves 7; this explains why the section B does not cause any or any pronounced defacing of or other damage to the surfaces of convolutions which advance along the surface 6 from the section A toward the discharge end Y. Since the force-locking engagement between the grooved surface 6 of the section B and the convolutions of the coil W is highly satisfactory, the section B can be short which is desirable on the ground that the overall axial length of the mandrel 1 can be kept to a minimum with the result that the wire D is subjected to a less pronounced heating action.

Figure 3:
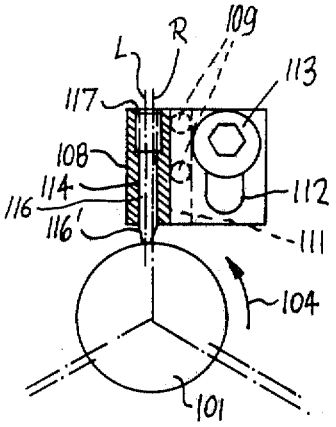
FIG. 3 is a fragmentary end elevational view of a second apparatus wherein the inner end portions of the wire guiding elements constitute conical frusta.

FIG. 3 shows a portion of a modified apparatus wherein all such parts which are identical with or clearly analogous to the corresponding parts of the apparatus of FIGS. 1–2 are denoted by similar reference characters plus 100. The only difference between the two apparatus is that the wire guiding pins 116 have frustoconical exposed end portions 116' which are adjacent to the periphery of the mandrel 101. Such configuration of the tips of pins 116 contributes to more satisfactory advancement of coiled wire toward the discharge end of the path which is defined by the three rows of pins 116.

Figure 4:
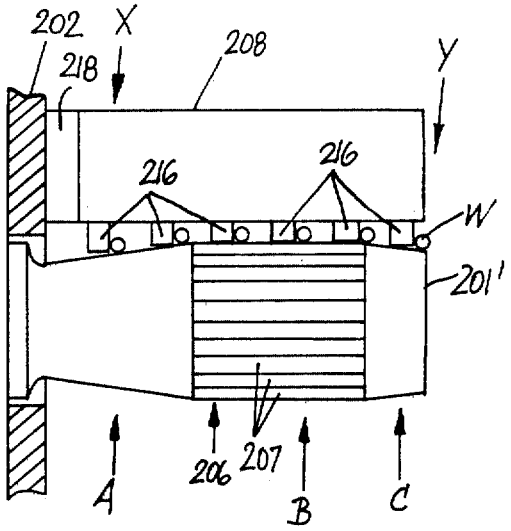
FIG. 4 is a fragmentary axial sectional view of a third apparatus wherein the mandrel comprises a cylindrical portion flanked by two frustoconical portions.

FIG. 4 shows a portion of a third apparatus wherein all such parts which are identical with or clearly analogous to the corresponding parts of the apparatus shown in FIGS. 1–2 are denoted by similar reference characters plus 200. The mandrel 201' of FIG. 4 comprises a third section C which has a conical or frustoconical external surface and whose larger-diameter end is adjacent to the respective end of the cylindrical section B. In the embodiment of FIG. 4, the section B is disposed between and is thus flanked by two frustoconical sections, namely, by the relatively long section A and the relatively short section C. The purpose of the section C is to ensure even more reliable and even more predictable advancement of the unsupported coil W in a predetermined direction, namely, in such a way that the coil W which has advanced beyond the free (smaller-diameter) end of the section C remains coaxial with the mandrel 201'. The tendency of convolutions which advance beyond the cylindrical section B to move out of axial alignment with the mandrel is attributable to a certain amount of contraction of windings which move beyond the section B. Such windings are guided by the frustoconical third section C so that the latter ensures that the coil W remains coaxial with the mandrel 201', not only during contact with the peripheral surface of the mandrel but also after having advanced beyond the section C. The cylindrical section B greatly reduces the likelihood of movement of unsupported convolutions of the wire W out of axial alignment with the mandrel, but such likelihood is reduced even further by the expedient of placing the cylindrical section B between two frustoconical sections A, C whose larger-diameter ends are adjacent to the respective ends of the cylindrical section. The section C guides the convolutions subsequent to slight contraction which takes place when a convolution advances beyond the right-hand end of the section B, as viewed in FIG. 2 or 4.

An important advantage of the improved apparatus is that the pins 16, 116 or 216 are rotatable about their respective axes L, i.e., that the rubbing frictional contact between the wire and the stationary pins of conventional apparatus is replaced by much less pronounced rolling frictional contact between the wire D and the rotating pins 16, 116 or 216 in the improved apparatus. The pins 16, 116 or 216 would be incapable of rotating relative to the mandrel 1, 101 or 201' if their exposed end faces would have a concave configuration and if such end faces were placed sufficiently close to the periphery of the mandrel to prevent penetration of thin wire between the pins and the mandrel while the pins would extend substantially radially of the mandrel. Thus, by the simple expedient of staggering the pins with reference to position radially of the mandrel (see particularly FIG. 1), it is now possible to rotate the wire guiding pins about their respective axes while the exposed end faces of the pins are sufficiently close to the periphery of the mandrel to effectively prevent penetration of thin or thick wire between the mandrel and the end faces of the pins. In the embodiments which are shown in FIGS. 1–2 and 3, the pins 16 and 116 are located ahead of the exact radial positions with reference to the corresponding mandrels 1 and 101 as considered in the direction of rotation of the mandrel 1 or 101 (see the arrows 4 and 104). The actual positions of the axes L are preferably parallel to the positions such axes would assume if the respective pins were disposed exactly radially of the corresponding mandrels.

The improved apparatus is believed to constitute the first known wire coiling device which need not resort to ball bearings but can use pin-shaped wire guiding elements and which permits such pin-shaped guiding elements to rotate about their axes so that the running wire is merely in rolling rather than rubbing frictional engagement with the pins.

Axial adjustability of the pins 16, 116 or 216 in their holders 8, 108 or 208 renders it possible to rapidly convert the apparatus for the processing of different types of wire as well as for the making of smaller- or larger-diameter wire coils. All that is necessary is to replace the illustrated mandrels with mandrels having larger or smaller radial dimensions and to effect an appropriate axial adjustment of the pins in their holders.

It has been found that three rows of pins suffice to ensure satisfactory guidance of the wire D during conversion into the convolutions of a wire coil, i.e., it suffices to provide composite holder means consisting of no more than three discrete holders. The holes or slots (such as the slots 12) and the fixing bolts (such as the bolts 13) render it possible to adjust the individual holders in the axial direction of the respective wire guiding pins. This renders it possible to conform the positions of the wire guiding pins to the radial dimensions of the selected coiling mandrels. Thus, adjustability of the holders in the axial direction of their pins renders it possible to conform the positions of the pins to different radial dimensions of the mandrels, and axial adjustability of the pins in their holders enables the pins to assume optimum positions with reference to the adjacent portions of the mandrels irrespective of the more or less pronounced conicity of the section A and/or C of a selected mandrel.

Machines which can convert wire coils into spiral binders and insert such binders into the perforations of stacked sheets for the purpose of making steno pads or the like are disclosed in commonly owned U.S. Pat. Nos. 4,157,821, 4,161,196, 4,165,766 and 3,232,858.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for converting a length of wire into a helical coil of predetermined pitch, comprising a rotary coiling mandrel; a plurality of substantially pin shaped wire guiding elements adjacent to the periphery of the mandrel and distributed in accordance with the pitch of the coil to be wound so as to define a helical path having an inlet and an outlet, said elements being rotatable about their respective axes and such axes being slightly offset with reference to radial positions relative to said mandrel; and means for supplying the wire into the inlet of said path whereby the rotating mandrel advances the wire along said path and the guiding elements shift the thus formed convolutions of the wire coil axially of the mandrel.

2. The apparatus of claim 1, wherein said wire guiding elements are movable axially with reference to and in directions toward and away from said mandrel.

3. The apparatus of claim 2, further comprising means for maintaining said wire guiding elements in selected axial positions.

4. The apparatus of claim 1, further comprising holder means rotatably supporting said wire guiding elements.

5. The apparatus of claim 4, wherein said holder means comprises a plurality of discrete holders and further comprising a support for said holders and means for adjustably securing said holders to said support so that each of said holders is adjustable substantially axially of the respective wire guiding elements.

6. The apparatus of claim 5, wherein said mandrel is rotatably journalled in said support.

7. The apparatus of claim 4, wherein said holder means comprises three holders and each of said holders supports a row of wire guiding elements.

8. The apparatus of claim 7, wherein each of said rows is at least substantially parallel to the axis of said mandrel.

9. The apparatus of claim 4, wherein each of said wire guiding elements is adjustable axially in said holder means and further comprising means for maintaining the wire guiding elements in selected axial positions.

10. The apparatus of claim 1, wherein said wire guiding elements have substantially conical end portions adjacent to said mandrel.

11. The apparatus of claim 1, wherein the axes of said wire guiding elements are offset with reference to radial positions relative to said mandrel through distances approximating the radii of the respective wire guiding elements.

* * * * *